United States Patent [19]

Lienhard, Sr.

[11] 4,413,707

[45] Nov. 8, 1983

[54] SUSPENDED CHAIN SCAFFOLDING EMPLOYING ADJUSTABLE POSTS WITH CHAIN THREADED THERETHROUGH

[75] Inventor: Robert W. Lienhard, Sr., Pittsburgh, Pa.

[73] Assignee: Swiss Fabricating, Inc., Pittsburgh, Pa.

[21] Appl. No.: 267,808

[22] Filed: May 28, 1981

[51] Int. Cl.[3] ..... E04G 3/10

[52] U.S. Cl. ..... 182/150; 182/130; 182/142

[58] Field of Search ..... 182/150, 142, 130, 131, 182/179, 178, 82; 211/113, 117, 118; 248/327, 248, 323

[56] References Cited

U.S. PATENT DOCUMENTS

| | | | |
|---|---|---|---|
| 1,484,480 | 2/1924 | Donaggio | 182/150 |
| 1,506,114 | 8/1924 | Donaggio | 182/150 |
| 1,662,859 | 3/1928 | Johnston | 182/150 |
| 1,725,183 | 8/1929 | Fischer | 182/142 |
| 2,038,521 | 4/1936 | Bell | 182/199 |
| 2,070,334 | 2/1937 | Garber | 182/150 |
| 2,102,484 | 12/1937 | Rapp | 182/199 |
| 2,556,105 | 6/1951 | Rhett | 182/199 |
| 3,159,243 | 12/1964 | Leonard | 182/150 |
| 3,245,188 | 4/1966 | Evans | 52/182 |
| 3,807,529 | 4/1974 | Reed | 182/82 |
| 4,057,943 | 11/1977 | Lienhard | 182/179 |
| 4,068,738 | 1/1978 | Reed | 182/150 |
| 4,253,549 | 3/1981 | Petren | 182/150 |

*Primary Examiner*—Reinaldo P. Machado
*Attorney, Agent, or Firm*—Robert D. Yeager

[57] ABSTRACT

A chain supported scaffolding arrangement for use inside of a building or vessel or in working under a bridge. Chain gripping plates engage the chain and support hollow tubular vertical posts which have a plurality of receptacles connected thereto. The chain engaging plates have a recess formed therein for receiving and positioning the vertical posts. Horizontal members engage the receptacles and extend between the vertical posts which are supported from the chains. The horizontal members are connected to the vertical posts by connectors which prevent movement about their connection axes so that when the various horizontal and vertical members are interconnected, a relatively stiff structure, which is chain supported, is provided.

7 Claims, 6 Drawing Figures

SUSPENDED CHAIN SCAFFOLDING EMPLOYING ADJUSTABLE POSTS WITH CHAIN THREADED THERETHROUGH

BACKGROUND OF THE INVENTION

1. Field of the Invention

This invention relates to scaffolding and more particularly to a chain-supported scaffolding for use inside of a building or vessel or in working under a bridge.

2. Description of the Prior Art

Scaffolding is often required in the interior of a building or vessel. It is desirable that the scaffolding utilized be flexible, and easily assembled and moved in the vessel. U.S. Pat. No. 4,057,943 teaches scaffolding arrangement for finishing the inside of an LNG vessel. U.S. Pat. No. 3,307,529 and U.S. Pat. No. 4,068,738 teach collapsable chain-supported scaffolding for use on a building or vessel.

SUMMARY OF THE INVENTION

The present invention is directed to a chain-supported scaffolding arrangement which is particularly suitable for use inside of a building or vessel or in working under a bridge. A plurality of spaced apart hanging vertical chains are utilized for providing support for vertical scaffolding posts. The vertical hanging chain can be attached to the roof or top of the vessel or pass through an opening formed in the top of the structure. A chain-engaging plate is fastened around a link of the chain at a desired location to engage and provide support for the associated vertical post. The chain-engaging plate has a recess formed in the top thereof for receiving and positioning the bottom of the associated vertical post. The spaced apart posts provided on the chains are interconnected by horizontal extending members which define horizontal levels. Each vertical post has a plurality of receptacles formed integral therewith. The ends of the horizontal members are provided with connectors which mate with or engage the receptacles on the vertical posts. The connectors and receptacle members are formed to prevent movement around their connection axes after engagement. When the various vertical posts and horizontal interconnecting members are assembled, a relatively stiff hanging scaffolding structure is provided. Planks can be provided between the various horizontal support members to provide a work surface.

A scaffolding arrangement according to the disclosed invention provides a relatively large and open horizontal work area without cross bracing or tie rods between the various horizontal levels. The work area provided on the horizontal levels is obstructed only by the vertical support posts. This scaffolding arrangement facilitates movement within the work area.

The desired locational positioning of the scaffolding can easily be changed by varying the location which the vertical posts are supported from the hanging chains. When not in use, the chains can be easily stored in a container. The various horizontal and vertical members are also easily disengaged and stored.

BRIEF DESCRIPTION OF THE DRAWINGS

For a better understanding of this invention, reference may be had to the preferred embodiment exemplary of the invention shown in the accompanying drawings in which.

DETAILED DESCRIPTION OF THE PREFERRED EMBODIMENTS

Figure 1:
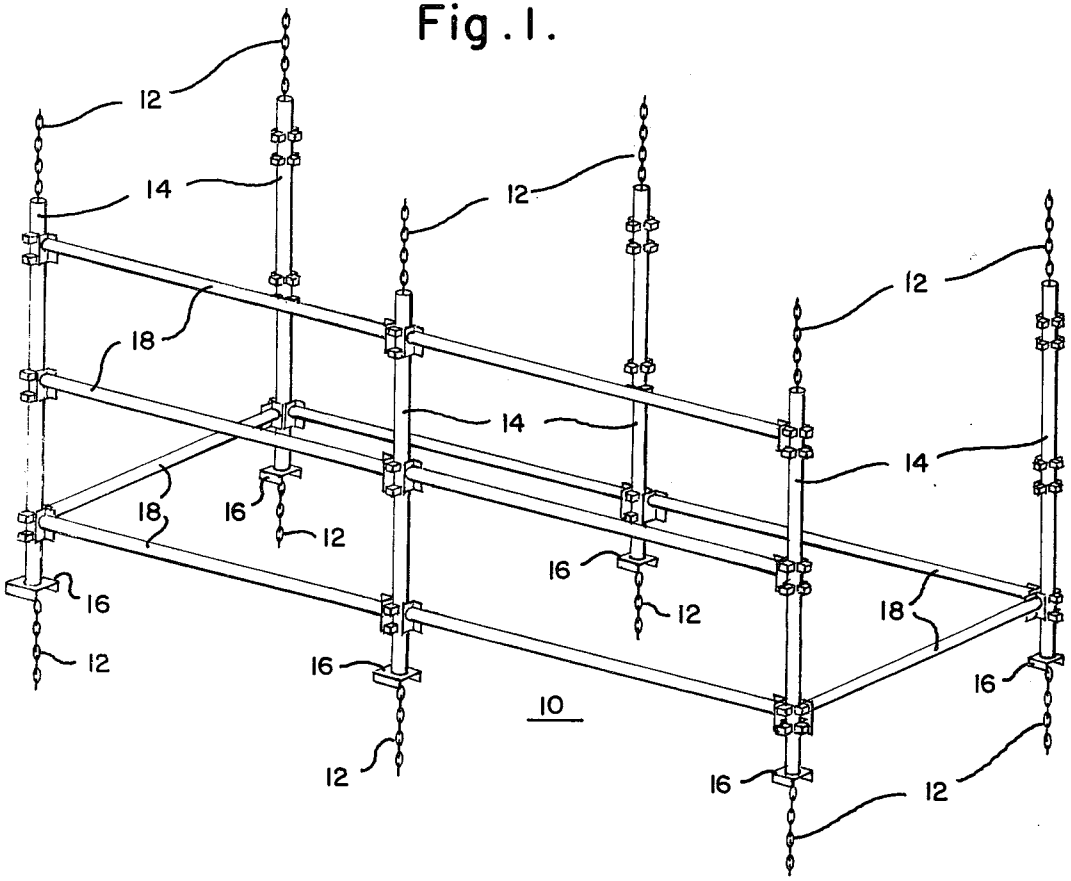
FIG. 1 is an isometric view according to the teaching of the present invention of a chain-supported scaffolding arrangement.
Figure 3:
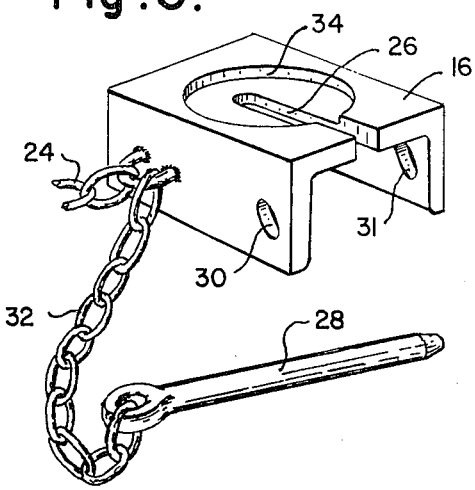
FIG. 3 is an isometric view of the chain-engaging plate utilized for supporting vertical posts from the chain.
Figure 4:
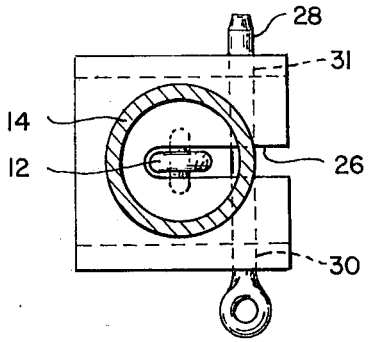
FIG. 4 is a top plan view of the chain-engaging plate shown in FIG. 3.

Referring now to the drawings and FIG. 1 in particular, there is shown a partially assembled scaffolding arrangement 10 constructed according to the teaching of the present invention. A plurality of vertically hanging chains 12 are provided within the area where scaffolding is desired. Vertical hanging chains 12 are spaced apart within the scaffolding area. A plurality of vertical posts 14 are supported from chain 12 by a slotted chain-engaging plate 16. Each vertical post 14 is supported from chain 12 by chain-engaging plate 16. Chain engaging plate 16 is fastened to chain 12. A plurality of horizontal members 18 extend between various vertical posts 14. Horizontal members 18 define various horizontal levels.

Suitable flooring, such as wooden planks, can be provided between horizontal members to define work areas. An additional plurality of horizontal members 18 can be positioned above and around the work areas to function as a safety guardrail. Several safety guardrail levels of horizontal members 18 can be provided above each work area if desired. Various vertically or horizontally spaced-apart work areas can be provided as desired.

Figure 2:
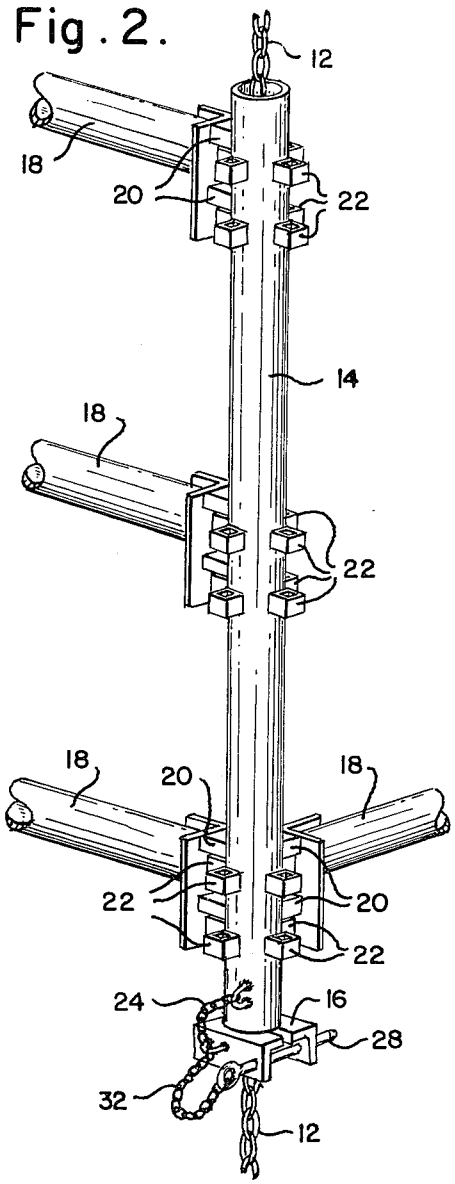
FIG. 2 is an enlarged view of a corner of the scaffolding arrangement shown in FIG. 1.

Referring now to FIG. 2, there is shown an enlarged view of a corner of the scaffolding arrangement 10 as shown in FIG. 1. Hollow vertical post 14 is disposed around chain 12. Posts 14 provide vertical support for scaffolding 10 from chains 12. Horizontal members 18 are supported only from vertical posts 14. That is, no cross bracing between horizontal members 18 of different horizontal layers is required other than the support provided by vertical posts 14. The ends of each horizontal member 18 are provided with connectors 20 which engage mating receptacles 22 on vertical posts 14. Alternately, the ends of horizontal member 18 can be formed with a square tubular member similar in cross section to receptacle members 22 and can be fastened to receptacles 22 by a square-securing pin. When the scaffolding arrangement is assembled and in place, various other horizontal members such as wooden planks can be used for interconnecting horizontal member 18 which are on the same work level. Preferably, the ends of the horizontal members are connected to the vertical posts by a strong connector which prevents movement around the connection axes such as a SWISS-LOK connection manufactured by Swiss Fabricating, Pittsburgh, Pa. The SWISS-LOK connection prevents movement of the horizontal members 18 about the point of connection to vertical posts 14 and provides for a relatively stiff or rigid structure when assembled. U.S. Pat. No. 4,057,943 assigned to the assignee of the present invention and whose teachings are hereby incorporated by reference discloses in more detail the desired type of connection between vertical members 14 and horizontal members 18.

Each vertical post 14 is supported by a slotted-support plate 16 which engages chain 12. Plate 16, which is shown in more detail in FIGS. 3 through 6, is fastened by a chain 24 to posts 14. This prevents support plate 16 from being separated from post 14 during storage. Plate 16 has a generally U-shaped cross section with slot 26 formed therein. Slot 26 is formed to fit around a link of chain 12. During use when plate 16 is in place, locking pin 28 is positioned through openings 30, 31 to prevent plate 16 from moving off of chain 12. Securing pin 28 is attached to support plate 16 by chain 32. With plate 16 in position, the chain link beneath the link disposed in slot 26 engages and supports the bottom of support plate 16. Support plate 16 has a recess 34 formed therein for receiving the bottom of post 14. Recess 34 maintains vertical posts 14 at a desired engagement position with plate 16. The use of link chain 12 permits the vertical position of post 14 to be adjustable, link by link, to achieve the desired height of the horizontal platform.

Figure 6:
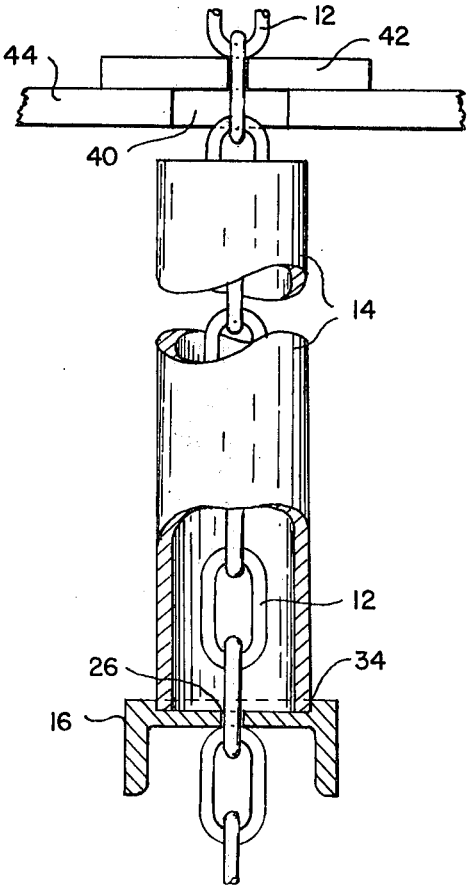
FIG. 6 is a view taken in FIG. 5 along the line VI-VI.
Figure 5:
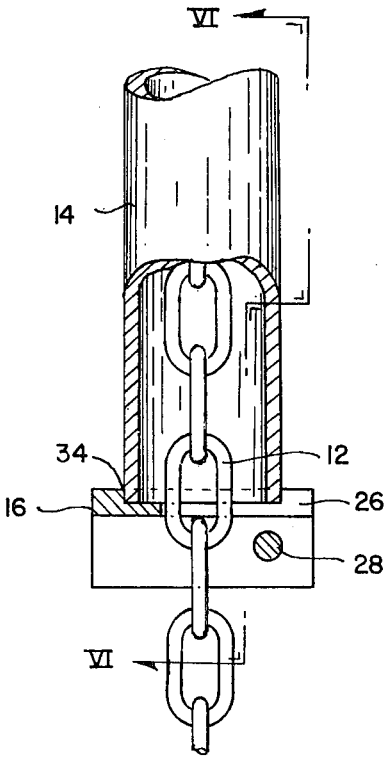
FIG. 5 is an enlarged fragmentary view of the chain-supporting plate and a portion of a vertical post.

Chain 12 can either be fastened to the top of a structure or as shown in FIG. 6, extend through an opening 40 formed therein. Opening 40 can be relatively small, being large enough only to allow chain 12 to pass freely therethrough. A slotted plate 42 or a pin can secure the chain to the outside of structure 44. Vertical chain 16 can be dropped through opening 40 at desired locations and secured at the top. Scaffolding structure 10 can then be installed. When the work is completed, the scaffolding structure 10 is removed and chain 12 can be withdrawn from the top of support 44 and conveniently stored in a container. The disclosed scaffolding is relatively easy to assemble, disassemble and store.

What is claimed is:

1. A scaffolding arrangement comprising:

a plurality of vertically extending chains;

a support plate engaging each chain at a selected height;

a vertical elongated post disposed around each chain and supported by an associated support plate;

a plurality of vertically spaced apart horizontal members interconnecting said hollow vertical posts; and, connecting means for connecting each horizontal member to its associated vertical posts for supporting the horizontal member and preventing pivotal movement around its associated vertical posts.

2. A scaffolding arrangement as claimed in claim 1 wherein said support plate comprises:

a generally U-shaped member having a slot formed in the light portion thereof for receiving a link of an associated chain;

a pin extending between the legs of the U-shaped member for locking the U-shaped member to the associated chain; and, a recess formed in a top flat portion of the U-shaped member for receiving and positioning the bottom of the associated vertical post.

3. A scaffolding arrangement as claimed in claim 1 wherein said connecting means comprises:

a plurality of spaced apart formed receptacles attached to said vertical posts; and a plurality of formed mating connector members attached to the horizontal member which engage a plurality of receptacles.

4. A scaffolding arrangement as claimed in claim 1 wherein said connecting means comprises:

a square tubular member vertically disposed and attached to said associated vertical post; and, a square male member connected to and fixed with respect to said horizontal member engaging said square tubular member attached to said associated vertical post.

5. A scaffolding arrangement as claimed in claim 1 wherein:

said chain extends through an opening in a support structure; and, retaining means for supporting said chain through the opening in the support structure.

6. A scaffolding assembly for connecting to a vertical hanging chain comprising:

a plurality of chain engaging means having a top flat surface with a recess formed therein for engaging the vertical hanging chain;

securing means associated with each chain engaging means for securing the chain engaging means to the vertical hanging chain; and, a vertical post associated with each securing means being hollow and disposed around the chain above said securing means and having a bottom formed with a cross section to mate in the recess of said chain engaging means.

7. A scaffolding as claimed in claim 6 comprising:

a plurality of horizontal members extending between the vertical posts;

connectors attached on each vertical posts for engaging said plurality of horizontal members and preventing pivotal movement around the point of connection to the vertical post.

* * * * *

UNITED STATES PATENT AND TRADEMARK OFFICE

CERTIFICATE OF CORRECTION

PATENT NO. : 4,413,707

DATED : November 8, 1983

INVENTOR(S) : Robert W. Lienhard, Sr.

It is certified that error appears in the above—identified patent and that said Letters Patent is hereby corrected as shown below:

Col. 1, line 18, delete "3,307,529" and substitute therefor --3,807,529--.

Signed and Sealed this

*Fourteenth* Day of *February 1984*

[SEAL]

*Attest:*

GERALD J. MOSSINGHOFF

*Attesting Officer*

*Commissioner of Patents and Trademarks*